US005607575A

United States Patent [19]

Kamiya et al.

[11] Patent Number: 5,607,575

[45] Date of Patent: Mar. 4, 1997

[54] PROCESS FOR REMOVING IRON IMPURITIES FROM PETROLEUM OIL DISTILLATION RESIDUES

[75] Inventors: Kozo Kamiya; Toru Morita; Yuichiro Fujiyama; Masaru Ushio, all of Yokohama, Japan

[73] Assignee: Nippon Oil Co., Ltd., Tokyo, Japan

[21] Appl. No.: 300,257

[22] Filed: Sep. 2, 1994

[30] Foreign Application Priority Data

Sep. 3, 1993 [JP] Japan ..... 5-243775

[51] Int. Cl.[6] ..... C10G 29/04

[52] U.S. Cl. ..... 208/251 R; 208/253; 209/8; 209/11; 209/214

[58] Field of Search ..... 208/251 R, 253; 209/8, 11, 214

[56] References Cited

U.S. PATENT DOCUMENTS

| | | | |
|---|---|---|---|
| 4,054,513 | 10/1977 | Windle | 209/214 |
| 4,116,829 | 9/1978 | Clark et al. | 209/214 |
| 4,298,456 | 11/1981 | Coombs et al. | 208/251 R |
| 4,342,640 | 8/1982 | Lewis | 208/251 R |
| 4,668,591 | 5/1987 | Minemura et al. | 209/223.1 |
| 4,695,333 | 9/1987 | Inoue et al. | 148/306 |
| 4,836,914 | 6/1989 | Inoue et al. | 208/251 |

FOREIGN PATENT DOCUMENTS

| | | |
|---|---|---|
| 0555593A1 | 8/1993 | European Pat. Off. . |
| 0626440A1 | 11/1993 | European Pat. Off. . |
| 62-54790 | 3/1987 | Japan . |

OTHER PUBLICATIONS

European Search Report EP 94 30 6462 dated May 16, 1995 (1 page).

*Primary Examiner*—Helane Myers
*Attorney, Agent, or Firm*—Panitch Schwarze Jacobs & Nadel, P.C.

[57] ABSTRACT

A process for removing iron impurities, inter alia iron or iron compounds, from petroleum oil distillation residues is disclosed in which a high gradient magnetic separator incorporates a pack of ferromagnetic fillers in the form of a generally flat or curved sheet-like strip. The ferromagnetic filler is a Fe—Cr alloy of a selected composition and the strip is of selected geometric characteristics such that the rate of removal of iron impurities can be maintained substantially at a maximum throughout the separation mode of operation prior to and after washing of the ferromagnetic filler.

7 Claims, 1 Drawing Sheet

PROCESS FOR REMOVING IRON IMPURITIES FROM PETROLEUM OIL DISTILLATION RESIDUES

BACKGROUND OF THE INVENTION

1. Field of the Invention

This invention relates to a process for removing iron impurities from petroleum distillation residues or heavy oils. More specifically, the invention is directed to such a process in which petroleum heavy oils are magnetically treated to remove iron contents therefrom.

2. Prior Art

As has been commonly practiced in the art of petroleum refining, residual oils resulting from atmospheric or vacuum distillation of a crude petroleum oil are subjected to hydrogenative treatment with use of a fixed-bed catalyst under elevated temperature and pressure conditions so as to obtain a variety of petroleum products or starting feedstocks for chemical processing.

In most cases, such residual oils contain considerable proportions of particulate iron or iron compounds, typically sulfides, of the order of 0.1–100 microns which emanate during the transport of a crude oil from a shipping tanker through a storage tank and delivery pipe lines to a distillation plant, or which result from corrosion or wear of such distillation plant equipment. Such iron impurities often accumulated to the order of 10–100 wt.ppm would tend to deposit on a catalyst bed or in between individual catalyst particles, resulting in plugged up reactor or deteriorated catalyst. Plugged up reactor would often lead to objectionably increased pressure drop to a point where the plant operation has to be discontinued.

In U.S. Pat. No. 4,836,914 and Japanese Laid-Open Patent Publication No. 62-54790 there is disclosed the use of a high gradient magnetic separator equipped with ferromagnetic fillers for removing iron impurities from heavy oils far more efficiently compared to centrifugal separators. However, the magnetic separation process has a drawback in that on account of literal limitations to the amount of iron impurities that can be deposited on the ferromagnetic fillers, it would require a repeated cycle of alternate energization and deenergization of the ferromagnetic material when handling huge amounts of heavy residual oil to be treated. The more frequent the cycle, the less is the rate of removal of iron impurities.

SUMMARY OF THE INVENTION

With the foregoing drawback of the prior art in view, the present invention seeks to provide a process for magnetically removing objectionable iron impurities typically from petroleum oil distillation residues which will ensure sustained efficiency and efficacy of removal of such iron impurities regardless of the number of cycles of magnetic energization required for the accumulation of and deenergization for the wash-down of iron impurities.

It has now been found that the above objective of the invention can be achieved by the selection of a particular material for and a particular configuration of ferromagnetic metal strips to be filled in a high gradient magnetic separator.

According to the invention, there is provided a process for removing iron impurities from petroleum oil distillation residues which comprises contacting the distillation residues with a ferromagnetic filler which is formed from an iron-chrome alloy consisting predominantly of iron, 5–25 percent by weight of chrome, 0.5–2 percent by weight of silicone, less than 2 percent by weight of carbon into a sheet-like strip having a varied thickness distribution and two different surface areas, the larger area of which being equal to an area of a true circle of a diameter (R) in the range of 0.1–4 mm, and the ratio of said diameter (R) to the maximum thickness (d) of said strip being in the range of 2–20.

DETAILED DESCRIPTION OF THE INVENTION

The term petroleum oil distillation residue or residual oil as used herein designates atmospheric or vacuum distillation residual oils of a petroleum crude oil, mixtures or deasphalted products thereof. Such distillation residual oils are prone to capture fine particles of iron or iron compounds such as iron sulfides or iron oxides during transport or storage which tend to concentrate even as high as to about 10–100 ppm and which range in particular size from 0.1 to 100 microns, predominantly less than 20 microns.

A high gradient magnetic separator or otherwise called a magnetic filter is largely classfied into a ferromagnet type using an excitation coil for energizing a ferromagnatic metal strip filler and a permanent magnetic type. Both types of magnetic separator can be used in the invention.

One important aspect of the present invention resides in the use of an iron-chrome (Fe—Cr) alloy for the ferromagnetic metal strip, the alloy consisting predominantly of iron, 5–25 wt. % preferably 8–20 wt. % of chrome, 0.5–2 wt. % of silicone and less than 2 wt. % of carbon.

Figure 1:
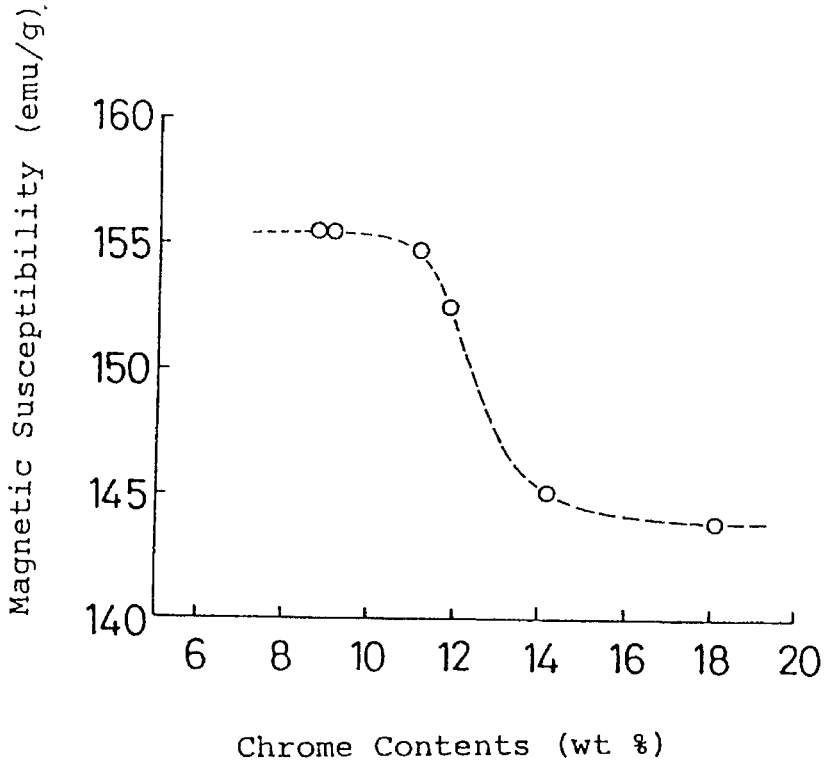
FIG. 1 is a graph illustrating the contents of chrome in the iron-chrome alloy plotted against the magnetic susceptibility.
Figure 2A:
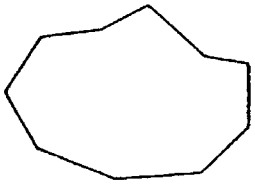
FIG. 2*a* is a plan view of a relatively flat sheet-like ferromagnetic metal strips.

The Fe—Cr alloy has its merit in low cost, mouldability, good corrosion and wear resistance and high magnetic susceptibility, thus finding satisfactory application as a ferromagnetic filler material for high gradient magnetic separator. The alloy exhibits a magnetic susceptibility which is generally higher the lower the chrome contents but which does not appreciably vary beyond 8 wt. % downwards as depicted in FIG. 1. On the other hand, too small chrome contents would lead to reduced mouldability and resistance to corrosion and wear. It has now been found that chrome contents in the range of 5–25 wt. % are most preferred in maintaining the best of these chracteristics for the Fe—Cr alloy.

Silicone contents as specified to be in the range of 0.5–2 wt. % are conducive to improved viscosity and oxidation resistance of the Fe—Cr alloy.

Carbon contents held to less than 2 wt. %, preferably 0.01–1 wt. %, are conducive to improved hardness and wear resistance of the Fe—Cr alloy.

Iron contents constituting a major portion of the Fe—Cr alloy should be preferably in the range of 71–94wt. %, more preferably 75–90 wt. %.

The Fe—Cr alloy according to the invention may further contain optionally Mn, Ni, Cu, Nb, Ti and Zr singly or in combination.

According to another important aspect of the invention, the ferromagnetic metal strip of the above composition is embodied in the form of a relatively flat or curved sheet-like body having two different surfaces of varied thickness, one of which surface is larger and equal in area to an area of a true circle having a diameter R =0.1–4 mm, preferably 0.1–4 mm, the ratio of diameter R to maximum thickness d of the strip being R/d in the range of 2–20, preferably 5–20.

Figure 3A:
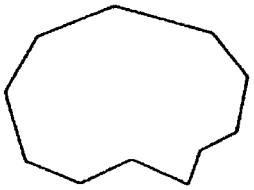
FIG. 3*a* is a plan view of a curved sheet-like ferromagnetic metal strip.
Figure 2B:
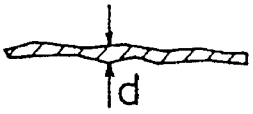
FIG. 2*b* is a cross-sectional view of the same.
Figure 3B:
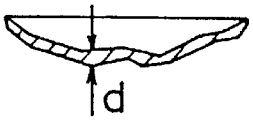
FIG. 3*b* is a cross-sectional view of the same.

The ferromagnetic metal strip has ridges and grooves which are arbitrarily discrete over its front and reverse sides. FIG. 2*b* examplarily illustrates a strip in the form of a relatively generally flat sheet-like body as viewed in cross section. FIG. 3*b* illustrates a strip cross-sectionally in the form of a curved or spherical sheet-like body. The strip has such a plan configuration as is optionally circular, oval, arcuate, rectangular, star-like, petal-like and so on.

The magnetic separation process of the invention is applicable to the treatment of a petroleum-based heavy oil such as atmospheric or vacuum distillation residual oil containing more than 5 ppm iron impurities which may be pretreated for deasphalting. The heavy oil under consideration may further contain other impurities such as nickel, vanadium, sulfur, nitrogen or asphaltene.

Optimum operating parameters for the high gradient magnetic separator may be chosen depending upon magnetic field strength, oil linear velocity and oil temperature. The strength of magnetic fields to be generated around the ferromagnetic filler ranges generally from 500 to 25,000, preferably from 1,000 to 10,000, more preferably from 2,000 to 6,000 gausses. The field strength remains zero gauss when the separator is in the wash-down mode of operation.

The temperature of the oil or washing liquid to be introduced into the magnetic separator should be usually in the range of from room temperature to 400° C., preferably 150° C.–350° C. during the separation mode of operation and in the range of from room temperature to 350° C., preferably 100° C.–250° C. during the wash-down mode of operation. To maintain proper treatment temperature, there may be provided a suitable cooling or heating means.

The oil linear velocity referred to herein designates a linear velocity of oil or washing liquid passing through the zone of the separator which is packed with the ferromagnetic metal strips. The velocity for the separation mode is usually in the range of 0.1–50 cm/sec., preferably 1.0–5 cm/sec. and should be held less the lower the rate of magnetization of, or the smaller the particle size of iron impurities to be separated. The velocity for the wash-down mode is in the range of 0.1–50 cm/sec., preferably 1–10 cm/sec.

The washing liquid to be used in the invention may be chosen from a variety of petroleum-based mineral oils such as atmospheric or vacuum distillation residual oil, hydrogenates thereof, or distillation residues of such hydrogenates. Washing time length ranges usually from 1 minute to 6 hours, preferably from 1 to 30 minutes. The washing liquid should preferably be directed upwardly toward and through the zone of the ferromagnetic metal strip pack so that the strips are held in a fluid state under agitation.

The invention will be further described by way of the following examples.

INCENTIVE EXAMPLES 1 & 2 AND COMPARATIVE EXAMPLE 1

The ferromagnetic fillers used in the respective examples are identified in Table 1 below.

TABLE 1

| | Configuration | Chemical Composition wt. % | | | |
|---|---|---|---|---|---|
| | | Fe | Cr | Si | C |
| Inventive Example 1 | Curved sheet-like metal strip | 87 | 11 | 1.3 | 0.08 |
| Inventive Example 2 | Curved sheet-like metal strip | 80 | 18 | 0.7 | 0.08 |
| Comparative Example 1 | Expanded metal | 80 | 18 | 0.7 | — |

The curved sheet-like metal strip (FIGS. 3*a* & 3*b*) used in Inventive Examples 1 and 2 had a maximum thickness d of 0.2 mm and an area of its larger surface equal to an area of a circle having a diameter R of 3 mm, hence R/d =15.

A feedstock oil, i.e. a petroleum vacuum residual oil containing 30 ppm of iron impurities was treated with the use of a high gradient electromagnetic separator "FEROSEP" (registered trademark) under the following conditions:

Strength of magnetic field: 3.0 kilogauss

Linear velocity: 2.5 cm/sec.

Temperature: 250° C.

The rate of separation or removal of iron impurities was approximately 60% at an initial stage of the separation mode of operation but declined to about 40% after a lapse of 4 hours, whereupon the supply of the feedstock oil was discontinued. The ferromagnetic filler was then washed under the following conditions:

Linear velocity of washing liquid: 2.0 cm/sec.

Temperature of washing liquid : 150° C.

Time length of washing : 10 minutes

The separation mode of operation of the separator was resumed with the thus cleaned ferromagnetic filler.

The ratio of removal of iron impurities from the feedstock oil was observed as indicated in Table 2 below.

TABLE 2

| | Rate of Iron Removal at Initial Separation Cycle | Rate of Iron Removal at Next Separation Cycle |
|---|---|---|
| Inventive Example 1 | 68 wt. % | 68 wt. % |
| Inventive Example 2 | 63 wt. % | 63 wt. % |
| Comparative Example 1 | 60 wt. % | 57 wt. % |

A comparison between the ferromagnetic filler of Inventive Example 2 and that of Comparative Example 1 shows that despite both fillers being of the same composition, the inventive filler of the specified geometric characteristics excels the comparative filler in the rate of removal of iron impurities both at the initial and the ensuing stage of the magnetic treatment of the same feedstock oil.

It will be also seen that the use of a ferromagnetic filler as in Inventive Example 1 containing less chrome than that in Inventive Example 2 is more effective in the treatment of iron impurities-containing petroleum heavy oils.

What is claimed is:

1. A process for removing iron impurities from petroleum oil distillation residues which comprises contacting the distillation residues with a ferromagnetic filler energized by a magnetic field having a strength of from 500–25,000 gauss, the ferromagnetic filler being formed from an iron-chrome alloy consisting predominantly of iron, 5–25 percent by weight of chrome, 0.5–2 percent by weight of silicon, and less than 2 percent by weight of carbon, into a strip, wherein the strip has a varied thickness distribution and two different surface areas, the larger area of which being equal to an area of a true circle of a diameter (R) in the range of 0.1–4 mm, and the ratio of said diameter (R) to the maximum thickness (d) of said strip being in the range of 2–20.

2. A process according to claim 1 wherein the contents of iron in said alloy are in the range of 71–94 wt. %.

3. A process according to claim 1 wherein said strip is cross-sectionally generally flat.

4. A process according to claim 1 wherein said strip is cross-sectionally curved.

5. A process according to claim 1 wherein said ferromagnetic filler contains at least one metal of the group of Mn, Ni, Cu, Nb, Ti and Zr.

6. A process for removing iron impurities from petroleum oil distillation residues which comprises passing the distillation residues at a linear velocity of 0.1–50 cm/sec through a pack of ferromagnetic fillers energized to a magnetic field strength of 500–25,000 gauss, said fillers being formed from an iron-chrome alloy consisting predominantly of iron, 5–25 percent by weight of chrome, 0.5–2 percent by weight of silicon, and less than 2 percent by weight of carbon into a strip having a varied thickness distribution and two different surface areas, the larger area of which being equal to an area of a true circle of a diameter (R) in the range 0.1–4 mm and the ratio of said diameter (R) to the maximum thickness (d) of said strip being in the range of 2–20, washing said pack of ferromagnetic fillers to regain normal impurities removal capabilities, and resuming the passage of said distillation residues through said pack of ferromagnetic fillers.

7. The process according to claim 6, wherein the temperature for passing the distillation residues through said energized pack of ferromagnetic fillers is from 150° C.–350° C.

* * * * *